US007712858B2

(12) United States Patent
Morimoto et al.

(10) Patent No.: US 7,712,858 B2
(45) Date of Patent: May 11, 2010

(54) IMAGE FORMING METHOD, IMAGE FORMING APPARATUS, AND PRINTER MATTER

(75) Inventors: Fumitoshi Morimoto, Shirakawa (JP); Takeo Miki, Machida (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 527 days.

(21) Appl. No.: 11/700,102

(22) Filed: Jan. 31, 2007

(65) Prior Publication Data

US 2007/0176966 A1 Aug. 2, 2007

(30) Foreign Application Priority Data

Jan. 31, 2006 (JP) ..... 2006-023884
Jan. 19, 2007 (JP) ..... 2007-010383

(51) Int. Cl.
*B41J 2/15* (2006.01)

(52) U.S. Cl. ..... 347/15; 347/41; 347/43

(58) Field of Classification Search ..... 347/12, 347/15, 43, 41; 358/1.2, 1.9
See application file for complete search history.

(56) References Cited

U.S. PATENT DOCUMENTS 4,999,646 A * 3/1991 Trask ..... 347/41
6,084,604 A * 7/2000 Moriyama et al. ..... 347/15
6,325,489 B2 * 12/2001 Endo ..... 347/43

FOREIGN PATENT DOCUMENTS

JP 06-59739 B2 8/1994

* cited by examiner

*Primary Examiner*—Lamson D Nguyen
(74) *Attorney, Agent, or Firm*—Pillsbury Winthrop Shaw Pittman, LLP

(57) ABSTRACT

In relation to a superimposed image obtained by superimposing second image data on first image data in which respective pixels are arranged in a staggered pattern, an image forming apparatus discriminates a region where the second image data is superimposed from a region where the second image data is not superimposed. When forming an image in a region determined as the region where the second image data is not superimposed in the superimposed image, the printing mechanism is controlled based on a first control pattern. When forming an image in a region determined as the region where the second image data is superimposed in the superimposed image, the printing mechanism is controlled based on a second control pattern different from the first control pattern.

6 Claims, 12 Drawing Sheets

| | | | | | | | | | |
|---|---|---|---|---|---|---|---|---|---|
| 11 | 12 | 13 | 14 | 15 | 16 | 17 | 18 | 19 | 1a |
| 21 | 22 | 23 | 24 | 25 | 26 | 27 | 28 | 29 | 2a |
| 31 | 32 | 33 | 34 | 35 | 36 | 37 | 38 | 39 | 3a |
| 41 | 42 | 43 | 44 | 45 | 46 | 47 | 48 | 49 | 4a |
| 51 | 52 | 53 | 54 | 55 | 56 | 57 | 58 | 59 | 5a |
| 61 | 62 | 63 | 64 | 65 | 66 | 67 | 68 | 69 | 6a |

| | | | | | | | | | |
|---|---|---|---|---|---|---|---|---|---|
| 11' | | 13' | | 15' | | 17' | | 19' | |
| | 22' | | 24' | | 26' | | 28' | | 2a' |
| 31' | | 33' | | 35' | | 37' | | 39' | |
| | 42' | | 44' | | 46' | | 48' | | 4a' |
| 51' | | 53' | | 55' | | 57' | | 59' | |
| | 62' | | 64' | | 66' | | 68' | | 6a' |

Main scanning direction

| Sub-scanning direction | 1 | 2 | 3 | 4 |
|---|---|---|---|---|
| 1 | XX | XX | XX | XX |
| 2 | XX | XX | XX | XX |
| 3 | XX | XX | XX | XX |
| 4 | XX | XX | XX | XX |

Count every line

Main scanning direction

| Sub-scanning direction | 1 | 2 | 3 | 4 |
|---|---|---|---|---|
| 1 | XX | 0 | XX | 0 |
| 2 | 0 | XX | 0 | XX |
| 3 | XX | 0 | XX | 0 |
| 4 | 0 | XX | 0 | XX |

Count every other line

IMAGE FORMING METHOD, IMAGE FORMING APPARATUS, AND PRINTER MATTER

CROSS-REFERENCE TO RELATED APPLICATIONS

This application is based upon and claims the benefit of priority from prior Japanese Patent Applications No. 2006-023884, filed Jan. 31, 2006; and No. 2007-010383, filed Jan. 19, 2007, the entire contents of both of which are incorporated herein by reference.

BACKGROUND OF THE INVENTION

1. Field of the Invention

The present invention relates to an image processing method and an image processing apparatus used for a thermal transfer recording mode of performing thermal transfer recording by using, e.g., a linear thermal head having a plurality of heat generators linearly arranged therein. The present invention also relates to a printed matter crated by using the image processing method and the image processing apparatus.

2. Description of the Related Art

As a method of recording a facial image in an image display unit having a facial image for personal authentication therein, e.g., various kinds of certificates, credit cards, or membership cards, a sublimation type thermal transfer recording method conventionally forms a mainstream. According to this sublimation type thermal transfer recording method, a thermal transfer ribbon obtained by coating a film-like support with a dye having sublimation properties (or heat transient properties) is superimposed on a recording target medium having an accepting layer that accepts the sublimation dye, the thermal transfer ribbon is selectively heated by, e.g., a thermal head based on original image data to be recorded, and a desired image is thereby subjected to sublimation transfer recording on the recording target medium.

In this sublimation type thermal transfer recording method, it is generally widely known that a color image that is rich in gradation properties can be easily recorded. However, in the sublimation type thermal transfer recording method, there is a drawback that materials that can be colored with a sublimation type material is limited and this method can adapt to limited recording target mediums only. Further, in general, the sublimation type dye is poor in image durability, e.g., light-resisting properties or solvent-resisting properties.

On the other hand, according to a fusion type thermal transfer recording method, a thermal transfer ribbon obtained by coating a film-like support with a material having a color pigment or a dye dispersed in a binder, e.g., a resin or a wax is selectively heated, and this ribbon is transferred together with the binder onto a recording target medium, thereby recording a desired image.

In this fusion type thermal transfer recording method, an inorganic or an organic pigment that is said to generally have excellent light-resisting properties can be selected as a color pigment. Further, in the fusion type thermal transfer recording method, an ingenuity can be exercised with respect to a resin or a wax used in a binder. Therefore, in the fusion type thermal transfer recording method, solvent-resisting properties can be improved. Furthermore, in the fusion type thermal transfer recording method, any recording target medium having adhesion properties with respect to a binder can be basically used. This method has an advantage, e.g., extensive selection of recording target mediums as compared with the sublimation type thermal transfer recording method.

However, the fusion type thermal transfer recording method uses a dot area gradation method of varying a size of transferred dots to perform gradation recording. Therefore, in order to accurately control a dot size to perform multi-gradation recording, various ingenuities are required. For example, there is a method of aligning arrays of pixels (dots) to be transferred in a staggered pattern to perform recording (which will be referred to as an alternate driving method hereinafter). When this alternate driving method is used, thermal interference of adjacent heat generators in a thermal head can be reduced, and a dot size can be controlled without being affected by adjacent pixels, thereby performing excellent multi-gradation recording.

Further, on a recording medium, e.g., an ID card is recorded a fluorescent image formed by using a transparent and colorless ink including a fluorescent pigment excited by ultraviolet light or the like in some cases. Furthermore, such a fluorescent image may be printed as continuous images (all pixels are printed) around a region printed by the alternate driving method. Such printing is intended to have an effect of causing a periphery of a fluorescent image (a region where continuous images are printed) to intensively emit light for provision of contrast, thereby improving an appearance. Such a technique is generally widely known.

However, the above-explained conventional technology has the following problems.

As explained above, in the alternate driving method, respective pixels (dots) constituting an image are rearranged into a staggered pattern to form an image. Therefore, pixel information of a part to which dots are not transferred is lost. In a multi-gradation image like a facial image, even if pixel information is lost in a staggered pattern, information as a facial image is not lost. However, in a binary image, e.g., a character or a geometric pattern, when dots are transferred in a staggered pattern, pixel information of a part to which dots are not transferred is lost, and there is a possibility that the image does not function as a character or a geometric pattern.

Moreover, in a printed matter, e.g., an ID card, various images are superimposed and printed to improve appearance in some cases. For example, a different image may be superimposed and printed on a background image, e.g., a fluorescent image. Additionally, a different image may be superimposed and printed on a fluorescent image including a region where all pixels are printed and a region printed by the alternate driving method. In such a case, in the fusion type thermal transfer recording mode, a printing state varies depending on each region where various images are superimposed. That is, when an image state or a recording medium state partially varies, printing the image with a uniform energy results in a problem that a region where a desired image cannot be obtained is present in the image (a printing result) printed on the recording medium.

BRIEF SUMMARY OF THE INVENTION

According to one aspect of the present invention, an object is to provide an image forming method and an image forming apparatus that can print an entire image in an excellent state. Further, another object is to provide a printed matter printed by using the image forming method.

According to one aspect of the present invention, there is provided an image forming method of forming an image on a recording medium by using a printing mechanism comprises discriminating a region where second image data is superimposed from a region where the second image data is not superimposed in relation to a superimposed image obtained by superimposing the second image data on first image data in which respective pixels are arranged in a staggered pattern, controlling the printing mechanism based on a first control pattern when forming an image in a region determined as the region where the second image data is not superimposed in the superimposed image, and controlling the printing mechanism based on a second control pattern different form the first control pattern when forming an image in a region determined as the region where the second image data is superimposed in the superimposed image.

According to another aspect of the present invention, there is provided an image forming method of forming an image on a recording medium by using a printing mechanism comprises discriminating a region where an image is formed in a specific region on a recording medium from a region where an image is formed in a region other than the specific region, controlling the printing mechanism based on a first control pattern when forming an image in the region other than the specific region, and controlling the printing mechanism based on a second control pattern different from the first control pattern when forming an image in the specific region.

According to still another aspect of the present invention, there is provided an image forming apparatus that forms an image on a recording medium by using a printing mechanism comprises a discriminating section that discriminates a region where second image data is superimposed from a region where the second image data is not superimposed in relation to a superimposed image obtained by superimposing the second image data on first image data in which respective pixels are arranged in a staggered pattern, a first control section that controls the printing mechanism based on a first control pattern when forming an image in a region determined as the region where the second image data is not superimposed in the superimposed image, and a second control section that controls the printing mechanism based on a second control pattern different from the first control pattern when forming an image in a region determined as the region where the second image data is superimposed in the superimposed image.

According to yet another aspect of the present invention, there is provided an image forming apparatus that forms an image on a recording medium by using a printing mechanism comprises a discriminating section that discriminates a region where an image is formed in a specific region on the recording medium from a region where an image is formed in a region other than the specific region, a first control section that controls the printing mechanism based on a first control pattern when forming an image in the region other than the specific region, and a second control section that controls the printing mechanism based on a second control pattern different form the first control pattern when forming an image in the specific region.

According to a further aspect of the present invention, there is provided a printed matter on which an image is formed by a printing mechanism comprises a region where second image data is not superimposed printed by the printing mechanism controlled based on a first control pattern in a superimposed image obtained by superimposing the second image data on first image data in which respective pixels are arranged in a staggered pattern, and a region where the second image data is superimposed printed based on a second control pattern different from the first control pattern in the superimposed image.

According to a still further aspect of the present invention, there is provided a printed matter on which an image is formed by a printing mechanism comprises a region other than a specific region where an image is printed by the printing mechanism controlled based on a first control pattern, and the specific region where an image is printed by the printing mechanism controlled based on a second control pattern different from the first control pattern.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments according to the present invention will now be explained hereinafter with reference to the accompanying drawings.

Figure 1:
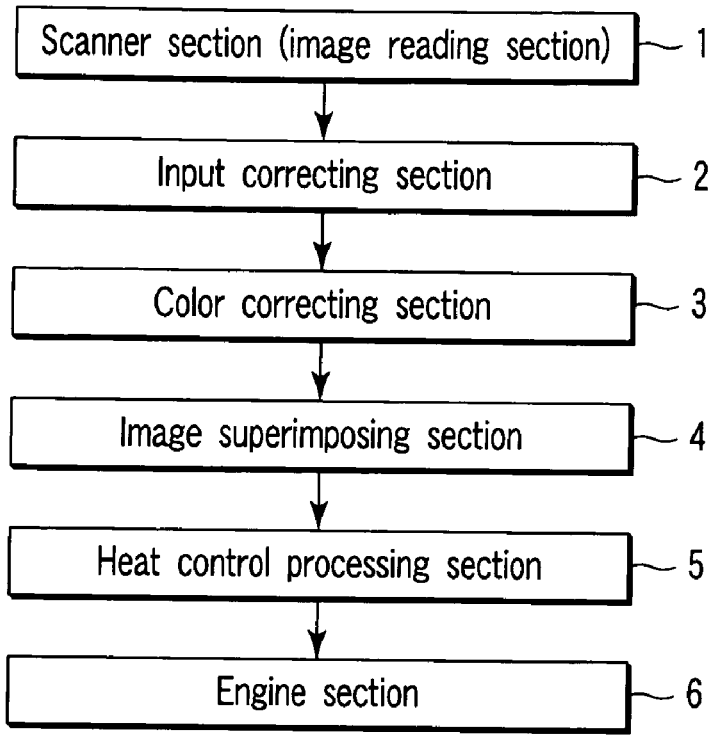
FIG. 1 is a block diagram schematically showing a structure of an image processing apparatus to which a first to a fourth image processing methods according to the present invention are applied.

FIG. 1 schematically shows a structural example of an image processing apparatus to which various image processing methods according to the present invention are applied.

As shown in FIG. 1, this image processing apparatus is constituted of a scanner section 1, an input correcting section 2, a color correcting section 3, an image superimposing section 4, a heat control processing section 5, an engine section 6, and others. It is to be noted that the input correcting section 2, the color correcting section 3, the image superimposing section 4, and the heat control processing section 5 may be configured by using hardware. Alternatively, these sections may be functions realized when a non-illustrated arithmetic processing section, e.g., a CPU executes a program stored in a non-depicted storage section.

The scanner section (an image reading section) 1 obtains an image. For example, the scanner section 1 reads an image on an original document as image signals (image data) of a color multi-gradation image (which may be a monochrome multi-gradation image) that are separated as an R (red), a G (green), and a B(blue) signals. The image data input by the scanner section is transmitted to the input correcting section 2. The input correcting section 2 performs correction, e.g., gamma correction with respect to the image signals input by the scanner 1. The color correcting section 3 corrects the image data corrected by the input correcting section 2 into image data separated into respective components of C (cyan), M (magenta), and Y (yellow) or C, M, Y, and K (black).

The image data separated into the components C, M, and Y or C, M, Y, and K by the color correcting section 3 is transmitted to the image superimposing section 4 that superimposes other image information. The image superimposing section 4 carries out superimposition processing of superimposing different image data on image data generated by the color correcting section 3. The image data generated by the image superimposing section 4 is supplied to the heat control processing section 5. Further, the image superimposing section 4 also functions as judging means that judges a state of image data to be recorded on a recording medium or a state of the recording medium on which image data is to be printed. It is to be noted that the judging means may be realized by the heat control processing section 5.

The heat control processing section 5 functions as controlling means for controlling the engine section 6. The heat control processing section 5 controls the engine section 6 in accordance with a state of an image to be printed or a state of a recording medium. For example, the heat control processing section 5 performs thermal control with respect to the engine section 6 in accordance with image data processed by the image superimposing section 4. In the heat control processing section 5, various kinds of control patterns are set in accordance with, e.g., states of an image. The heat control processing section 5 selects a control pattern with respect to the engine section 6 in accordance with a result of an judgment on, e.g., a state of an image or a state of a recording medium on which an image is to be printed.

The engine section 6 is an image output section adopting a fusion type thermal transfer recording mode using a linear thermal head in which a plurality of heat generators are linearly arranged in a main scanning direction. An energy supplied to the heat generators of the thermal head is controlled by the heat control processing section 5. The heat generators of the thermal head generate heat by using an energy that is given as a pulsed current by control of the heat control processing section 5. That is, the engine section 6 carries out processing of printing image data generated by the image superimposing section 4 or an image, e.g., an image supplied from an external device on a recording medium in accordance with heat control by the heat control processing section 5. Further, the engine section 6 has a function of performing printing in an alternate driving mode of alternately driving respective heat generators in one line to form an image on the recording medium, and a function of driving all heat generators in one line to form an image on the recording medium. Furthermore, the engine section 6 can perform control on each heat generator corresponding to a state of pixels in an image that should be printed in accordance with, e.g., control by the heat control processing section 5.

Image forming processing based on the alternate driving mode will now be explained.

An example where a multi-gradation image is a monochrome image will be explained to simplify a description. However, a technique explained below can be likewise applied to an example where a multi-gradation image is a color image.

Figure 2:
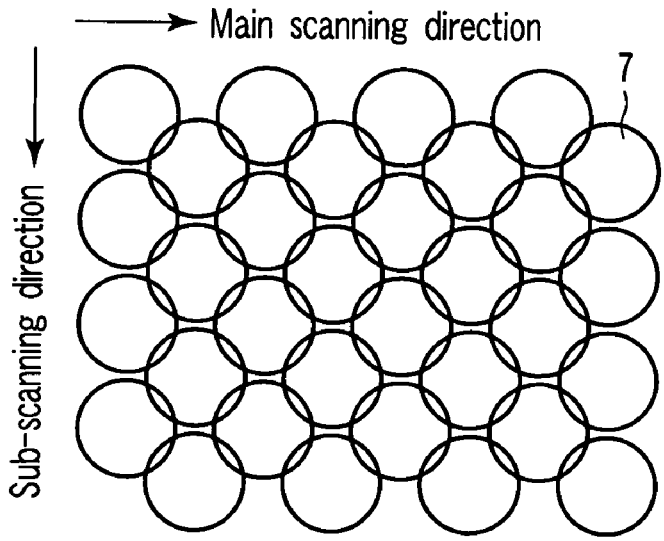
FIG. 2 is a view showing an arrangement example of dots when heat generators in a thermal head are alternately driven.

It is to be noted that a mode of alternately transferring an odd-numbered transfer dot (a pixel) and an even-numbered transfer dot (a pixel) in the main scanning direction in accordance with each line in a sub-scanning direction will be referred to as the alternate driving mode. For example, a method of alternately driving the heat generators in the thermal head to print an image or a method of recording an image formed of pixels arranged in a staggered pattern will be referred to as the alternate driving mode. For example, as shown in FIG. 2, respective pixels (dots) 6 recorded in the alternate driving mode are printed on the recording medium as an image in which the respective pixels are arranged in a staggered pattern. Here, the main scanning direction is a direction along which the heat generators in the thermal head are arranged, and the sub-scanning direction is a direction perpendicular to the former direction.

Figure 3A:
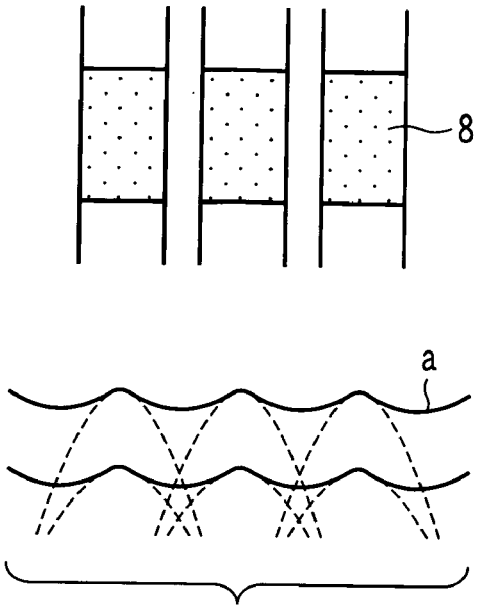
FIG. 3A is a view showing a temperature distribution when all heat generators are driven.
Figure 3B:
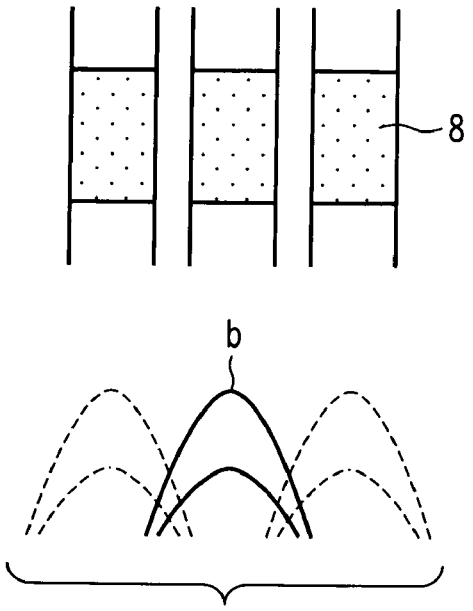
FIG. 3B is a view showing a temperature distribution when adjacent heat generators are alternately driven.

Each of FIGS. 3A and 3B shows the heat generators of the thermal head and a temperature distribution in an ink layer of the thermal transfer ink ribbon. In FIGS. 3A and 3B, reference numeral 7 denotes each heat generator of the thermal head. FIG. 3A is a view showing a temperature distribution when all the heat generators 7 are driven. As shown in FIG. 3A, when recording an image by driving all the heat generators 7 rather than alternately driving the heat generators 7, a distance between the heat generators 7 adjacent to each other is small, the heat generators adjacent to each other provoke a heat interference, and the temperature distribution has a flat shape (a solid line a in FIG. 3A). That is, there is no temperature contrast between the heat generators 7 adjacent to each other. Therefore, accurate dot size modulation cannot be performed, and multi-gradation recording is difficult.

On the other hand, FIG. 3B is a view showing a temperature distribution when the heat generators 7 adjacent to each other are alternately driven. As shown in FIG. 3B, in case of alternate driving of alternately driving the heat generators 7 adjacent to each other, the temperature distribution has a precipitous shape (a solid line b in FIG. 3B). That is because a distance between the driven heat generators 7 is large (in detail, a distance that is double a heat generator aligning pitch) and heat of the heat generator driven in the thermal head is transmitted to the adjacent heat generator 7 that is not driven, thereby rarely causing a heat interference.

That is, in alternate driving, temperature contrast can be taken between the heat generators 7 adjacent to each other. Moreover, in the above-described alternate driving, each independent dot can be assuredly formed, and a dot size can be securely modulated without being affected by an adjacent dot, thus enabling multi-gradation recording using an area gradation.

An image printed by the engine section 6 will now be explained.

Figure 4:
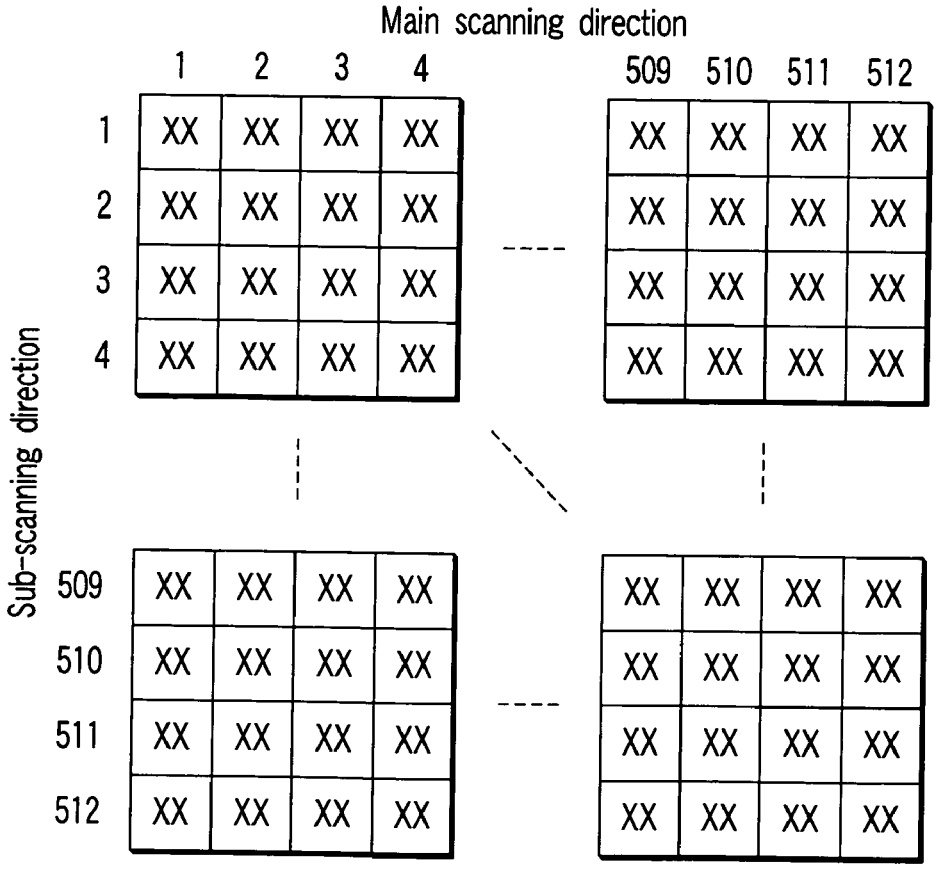
FIG. 4 is a view showing an example of an arrangement of pixels in image data.

FIG. 4 shows, e.g., alignment of pixels in image data read by the scanner section 1. Numeric characters in FIG. 4 denote a line number of each pixel in the main scanning direction and a line number of the same in the sub-scanning direction. In regard to each pixel in one line in the main scanning direction (e.g., a sub-scanning line number 1—main scanning line numbers 1 to 512 in FIG. 4), data of each pixel corresponding to one line is transferred to a non-illustrated thermal head driving circuit, the data of each pixel is developed into thermal head driving data, and then the thermal head is driven.

Figure 5:
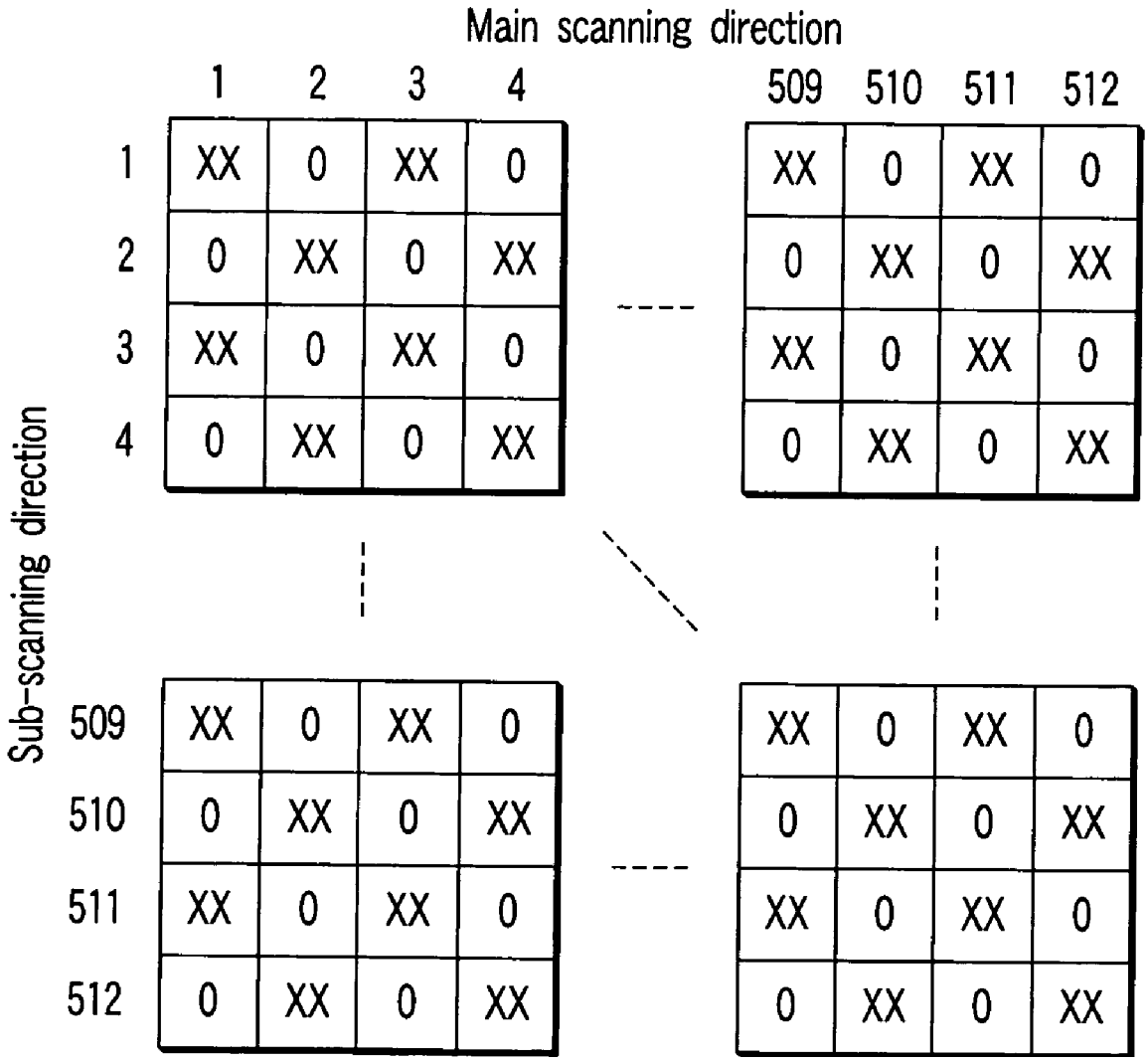
FIG. 5 is a view showing an example of image data obtained by converting respective pixels in the image data depicted in FIG. 4 into an arrangement having a staggered pattern.

In the image forming method adopting the alternate driving mode, an odd-numbered heat generator in an odd-numbered line in the sub-scanning direction and an even-numbered heat generator in an even-numbered line in the sub-scanning direction are alternately driven. Therefore, as shown in FIG. 5 image data printed by the image forming method adopting the alternate driving mode must have a structure in which respective pieces of data that are not actually recorded (obtained by driving no heat generator) (data 0 in an example shown in FIG. 5) are arranged in a staggered pattern and respective pieces of pixel data that are actually recorded are arranged at positions that do not correspond to the data 0.

That is, in regard to each pixel in image data printed by the image forming method adopting the alternate driving mode, a pixel adjacent thereto in the main scanning direction must have the data 0. This means that information of each pixel at the position corresponding to the data 0 is lost when the respective pixels of a superimposed image obtained by superimposing a different image on an original image are arranged in a staggered pattern. That is, when the superimposed image is simply printed in the alternate driving mode, a part of information of the superimposed image (an embedded image) is lost. The engine section 6 has a function of printing a specific region (e.g., a region where a different image is superimposed) in a given image by using all pixels and also printing regions other than the specific region in the image based on the alternate driving mode. As a result, the engine section 6 can print the superimposed image without losing information of the superimposed image. It is to be noted that a region printed by using all pixels (e.g., a region of a superimposed image) will be referred to as an all-pixel aligned part, and a region printed based on the alternate driving mode (e.g., a region other than the region of the superimposed image) will be referred to as an alternate pixel aligned part here.

Moreover, when superimposing and printing a multi-gradation image or a binary image on a fluorescent image having an all-pixel aligned part and an alternate pixel aligned part, the multi-gradation image or the binary image may be possibly superimposed on a part having no fluorescent image, the all-pixel aligned part of the fluorescent image, and the alternate pixel aligned part of the fluorescent image. Printing the image superimposed on the different regions by using a uniform energy leads to a printing result that varies depending on each region. That is because a heat conductivity or specific heat varies in accordance with a state on a recording medium (e.g., an image printed on the recording medium). On the other hand, the engine section 6 is configured to change a heat control pattern with respect to each region of one image in accordance with control by the heat control processing section 5.

As the image processing method applied to the above-described image processing apparatus, a first to a fourth image processing methods will now be explained in detail.

A first image processing method will be first explained in detail.

In this first image processing method, a processing method when embedding a different image (second image data) in a multi-gradation image (first image data) acquired by the scanner section 1 will be described.

Figure 6:
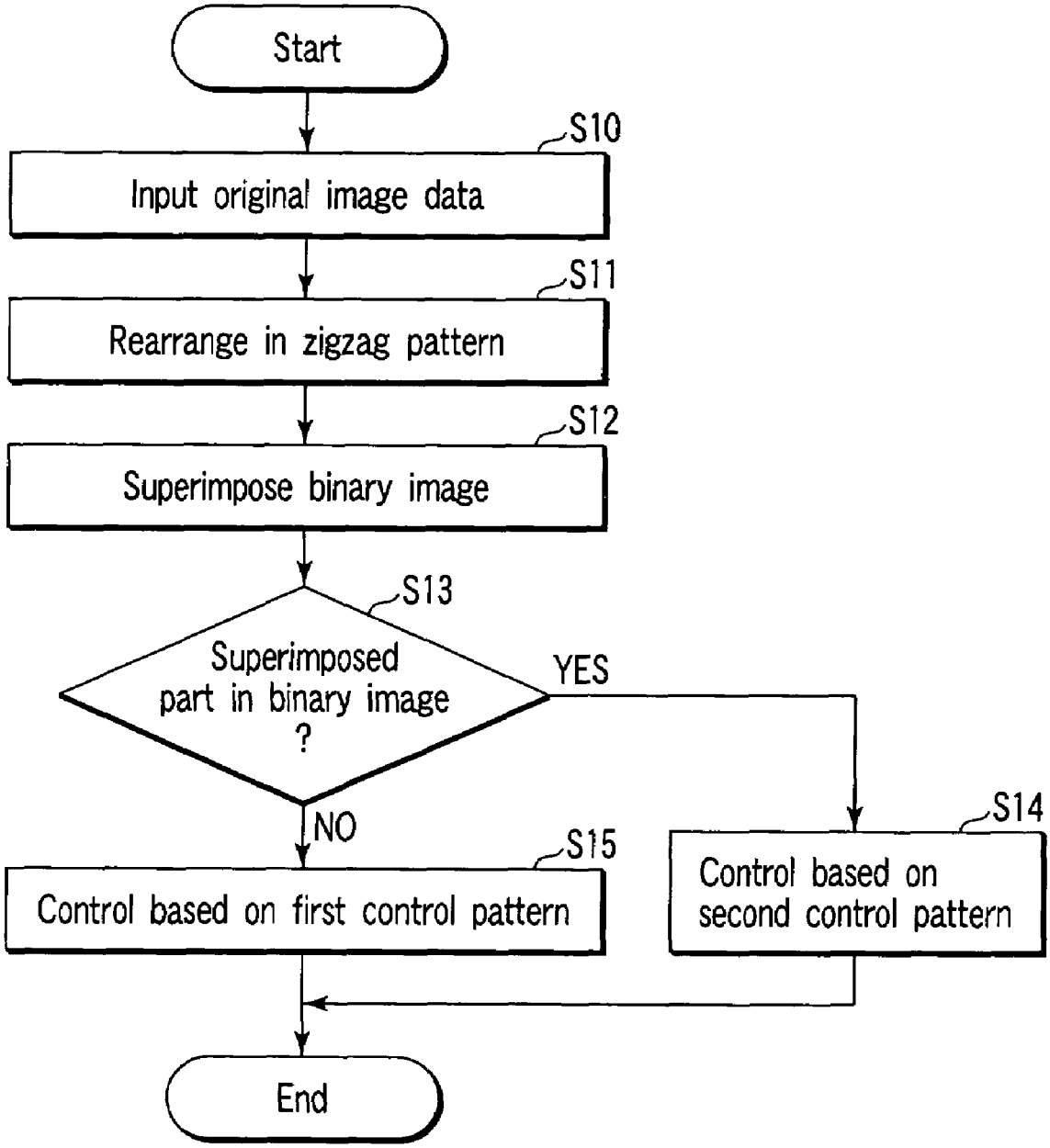
FIG. 6 is a flowchart for explaining a flow of processing by a first image processing method.

FIG. 6 is a flowchart schematically showing a flow of the first image processing method. First, the scanner section 1 acquires monochrome original image (first image) data in which respective pixels are separated into Y, M, and C or Y, M, C, and K (a step S10).

The input correcting section 2 and the color correcting section 3 carry out desired data processing with respect to the respective pixels in the first image data acquired by the scanner section 1. The first image data processed by the input correcting section 2 and the color correcting section 3 is supplied to the image superimposing section 4. The image superimposing section 4 rearranges the respective pixels in the first image data into a staggered pattern (a step S11).

Figures 7A, 7B:
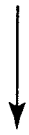
FIG. 7A is a view showing an example of first image data.
FIG. 7B is a view showing an example where respective pixels in the image data depicted in FIG. 7A are rearranged into a staggered pattern.

FIG. 7A is a view showing an example of the first image data. FIG. 7B is a view showing an example where the respective pixels in the image data depicted in FIG. 7A are rearranged into the staggered pattern. That is, as shown in FIG. 7B, in the image data depicted in FIG. 7A, respective even-numbered pixels in the odd-numbered main scanning directions are thinned out in the sub-scanning direction, and respective odd-numbered pixels in the even-numbered main scanning directions are thinned out in the sub-scanning direction. It is to be noted that a value of each remaining pixel (a value of each odd-numbered pixel in an odd-numbered scanning direction in the sub-scanning direction and a value of each even-numbered pixel in an even-numbered scanning direction in the sub-scanning direction) may be an original pixel value or may be an average value of values of adjacent thinned-out pixels.

When the respective pixels in the first image data are rearranged in the staggered pattern, the image superimposing section 4 performs processing of superimposing a different image (second image data) on the image data in which the respective pixels are rearranged in the staggered pattern (a step S12). The second image data may be a multi-valued image or a binary image, e.g., a character or a geometric pattern. Here, a description will be given on the assumption that the second image data is a binary image like a character.

That is, when superimposing the second image data on the first image data in which the respective pixels are rearranged in the staggered pattern, the image superimposing section 4 rewrites a value of each pixel of the pixels in the first image data on which each pixel in the second image data that should be printed is superimposed. That is, a value of each pixel in the first image data on which each pixel (a black pixel) in the second image data that should be printed is superimposed is overwritten with a value of the corresponding pixel in the second image data. Additionally, a value of each pixel in the first image data on which each pixel (a white pixel) in the second image data that is not printed is superimposed is kept as it is.

When the image superimposing section 4 superimposes the second image data on the first image data, the heat control section 5 performs heat control processing in accordance with a state of each pixel in the superimposed image with respect to the engine section 6. That is, the heat control processing section 5 first judges whether each pixel in the superimposed image is a pixel on which each pixel in the second image data is superimposed (a step S13). As a result, the heat control processing section 5 performs processing of controlling the engine section 6 with a first heat control pattern to effect printing on a recording medium with respect to a pixel that is determined to have no second image data superimposed thereon (or a peripheral pixel of this pixel) (a step S14). Further, in regard to a pixel that is determined to have the second image data superimposed thereon (or a peripheral pixel of this pixel), the heat control processing section 5 carries out processing of controlling the engine section 6 with a second heat control pattern to effect printing on the recording medium.

An example of heat control processing with respect to a superimposed image will now be explained.

Figures 8A, 8B, 8C, 8D:
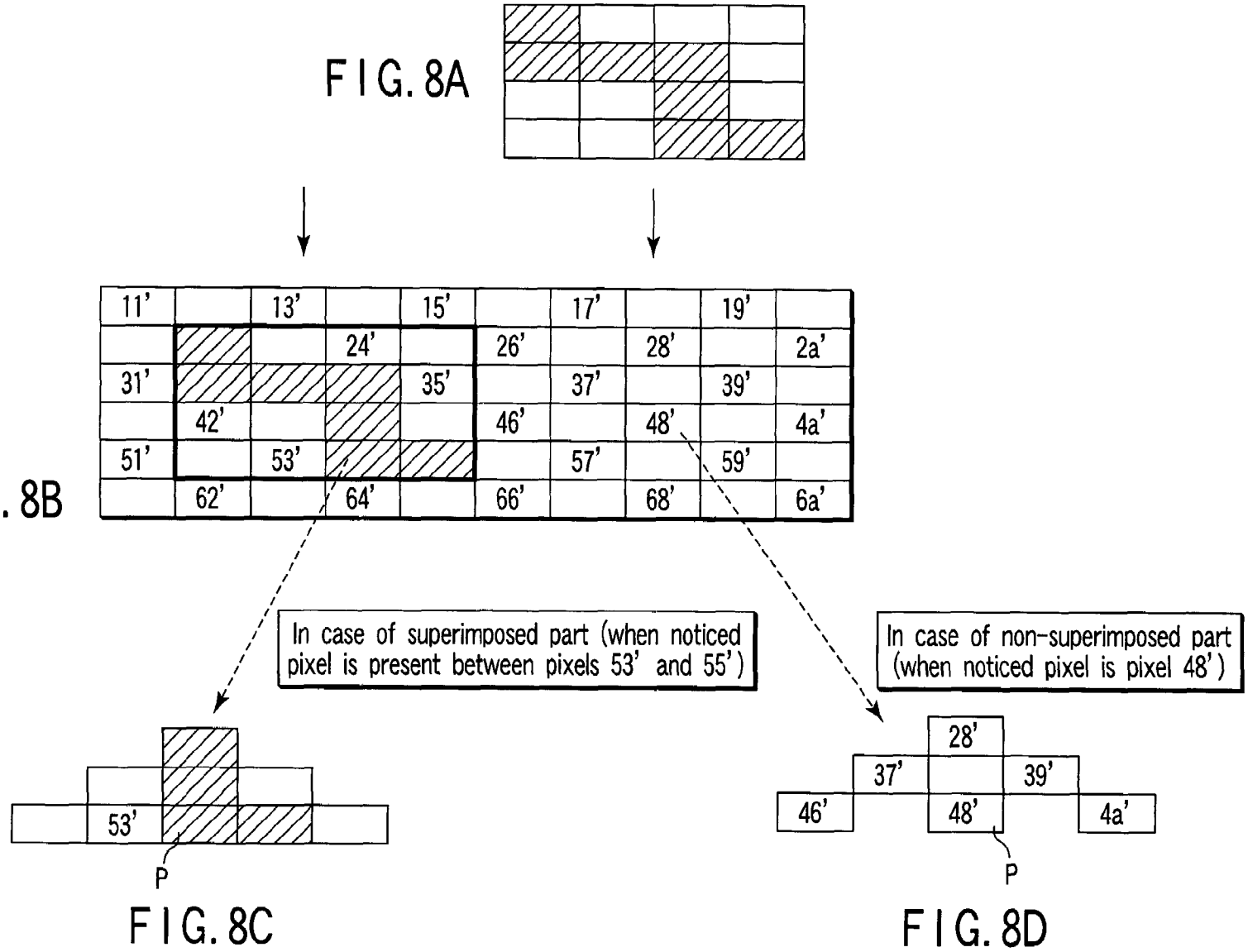
FIG. 8A is a view showing a binary image as second image data superimposed on the first image data.
FIG. 8B is a view showing an example of image data obtained by superimposing such a binary image as depicted in FIG. 8A on the first image data in which respective pixels are arranged in a staggered pattern.
FIG. 8C is a view showing an example of a peripheral region of a pixel on which a pixel of the second image data is superimposed in the image data depicted in FIG. 8B.
FIG. 8D is a view showing an example of a peripheral region of a pixel on which a pixel of the second image data is not superimposed in the image data depicted in FIG. 8B.

FIG. 8A is a view showing an example of a binary image as the second image data superimposed on the first image data. Furthermore, FIG. 8B is a view showing an example of image data obtained by superimposing such a binary image as depicted in FIG. 8A on the first image data in which respective pixels are arranged in a staggered pattern. FIG. 8C is a view showing an example of a peripheral region of a pixel in the image data depicted in FIG. 8B on which a pixel in the second image data is superimposed. FIG. 8D is a view showing an example of a peripheral region of a pixel in the image data depicted in FIG. 8B on which a pixel in the second image data is not superimposed.

In FIG. 8A, pixels that should be printed among respective pixels in a binary image are indicated by oblique lines, and pixel parts that are not printed are indicated by blank. Here, as superimposition processing by the image superimposing section, it is determined that the binary image shown in FIG. 8A is superimposed in a frame indicated by a bold line in the first image data in which pixels are arranged in a staggered pattern as depicted in FIG. 8B. In this case, as shown in FIG. 8B, in a superimposed image, a value of each pixel (each pixel part indicated by oblique lines in FIG. 8B) in the first image data on which each pixel in the binary image depicted in FIG. 8A that should be printed is superimposed is overwritten with a value of the pixel in the binary image. In regard to such a superimposed image, the heat control processing section 5 performs heat control processing for the engine section 6 in accordance with a state of each pixel.

For example, the heat control processing section 5 determines that a pixel between a pixel "53'" and a pixel "55'" shown in FIG. 8B is a pixel in a region where the second image data is superimposed. In this case, the heat control processing section 5 determines that the second heat control pattern is applied to a peripheral region of this pixel. Here, in regard to the pixel in the region where the second image data is superimposed, it is determined that the second heat control pattern 2 is applied to a region corresponding to eight pixels around this pixel. Then, the heat control processing section 5 determines that the second heat control pattern is applied to the region corresponding to eight pixels around such a pixel between the pixel "53'" and the pixel "55'" as shown in FIG. 8C.

Further, the heat control processing section 5 determines that a pixel "48'" shown in FIG. 8B is a pixel in a region where the second image data is not superimposed. In this case, the heat control processing section 5 determines that the heat control pattern 1 is applied to this pixel or a peripheral region of this pixel. Here, in regard to a pixel in the region where the second image data is not superimposed, it is determined that the first heat control pattern is applied to five pixels around this pixel among respective pixels arranged in the staggered pattern. Then, the heat control processing section 5 applies the first heat control pattern to such a region corresponding to the five pixels around the pixel "48'" among the respective pixels arranged in the staggered pattern as shown in FIG. 8D.

An example of a printed matter created by the first image processing method will now be explained.

Figure 9:
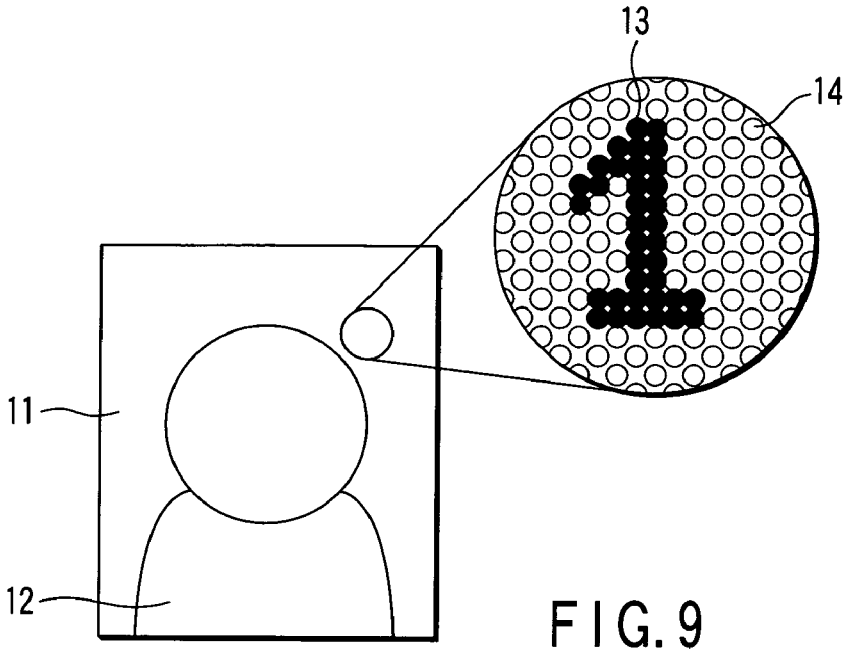
FIG. 9 is a view showing an example of a printed matter created by the first image processing method.

FIG. 9 shows an example of a printed matter 11 created by the first image processing method.

As shown in FIG. 9, on the printed matter 11 is printed a multi-gradation image (a facial image) 12 in which respective pixels are arranged in a staggered pattern. An image indicating a numeric figure "1" as a binary image is superimposed on the multi-gradation image 12. Enlarging a region where this binary image is superimposed as shown in FIG. 9, an identifiable binary image (a numeric figure "1") 13 can be identified. It is to be noted that reference numeral 14 denotes enlarged dots.

As depicted in FIG. 9, in the printed matter 11 created by the first image processing method, "1" as the binary image (second image data) embedded in the multi-gradation image (first image data) in which respective pixels are arranged in a staggered pattern can be readily identified. In the printed matter 11 created by the first image processing method, a region where the binary image is embedded and a region where the binary image is not embedded are printed in respective optimum states. As a result, in the printed matter 11 created by the first image processing method, the binary image (the second image data) embedded in the multi-gradation image 12 can be readily identified.

According to the first image processing method, in regard to the superimposed image obtained by embedding the second image data in a partial region of the first image data, different types of heat control are carried out with respect to the region of pixels having the second image data superimposed thereon and the region of pixels having no second image data superimposed thereon, thereby printing the superimposed on the recording medium.

As a result, according to the first image processing method, each region of the superimposed image obtained by embedding the second image data in the first image data can be formed on the recording medium by appropriate heat control. Consequently, according to the first image processing method, continuous binary images, e.g., characters embedded in alternate pixel aligned parts of a multi-gradation image can be assuredly printed on the recording medium, and these image regions can be appropriately printed on the recording medium. Furthermore, in the printed matter created by the first image processing method, an image superimposed on an image printed based on the alternate driving mode can be assuredly printed, thus securely restoring the superimposed image.

A second image processing method will now be explained in detail.

This second image processing method is a method concerning processing of superimposing and printing a different image on a given image. A description will be given on the assumption that a different image is printed on a recording medium on which a fluorescent image (a specific region in the recording medium) as a background image is printed.

Figure 10B:
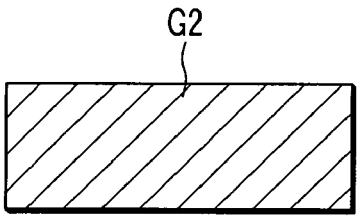
FIG. 10B is a view showing a multi-gradation image superimposed and printed on a fluorescent image.
Figure 10A:
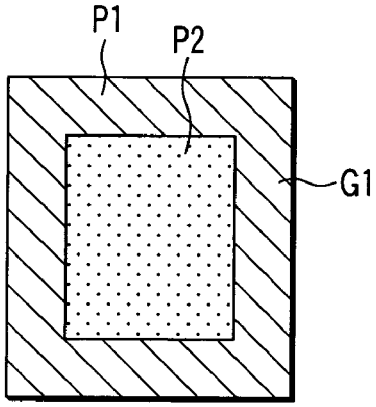
FIG. 10A is a view showing an example of a fluorescent image having a region where all pixels are printed (an all-pixel aligned part) and a region where pixels arranged in a staggered pattern are printed (an alternate pixel aligned part)
Figure 10C:
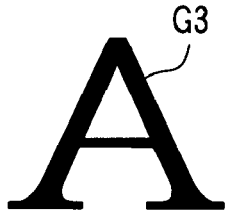
FIG. 10C is a view showing an example of a binary image superimposed and printed on a fluorescent image.
Figure 11:
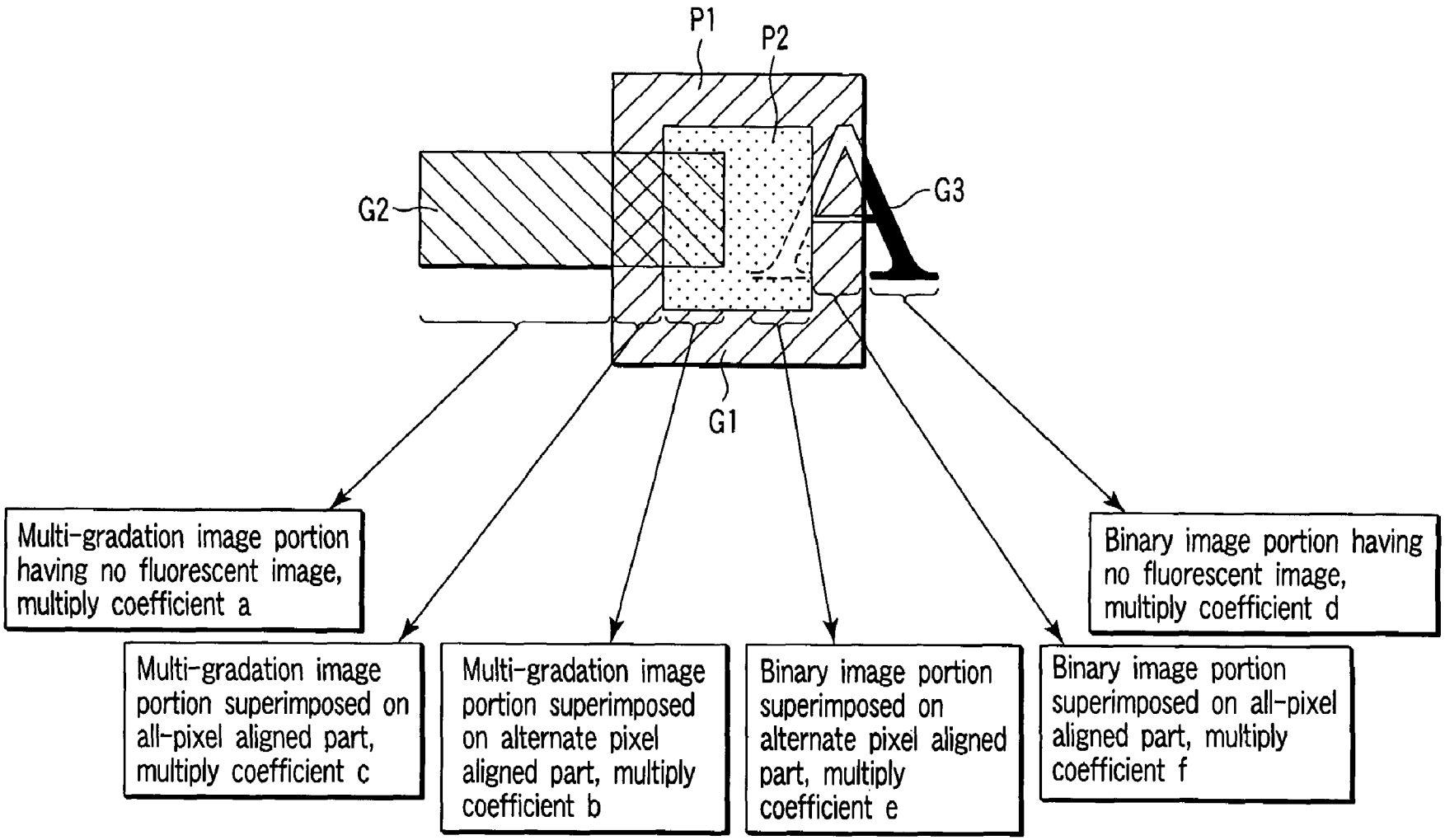
FIG. 11 is a view showing a state where a multi-gradation image and a binary image are superimposed and printed on a fluorescent image.

FIGS. 10A to 10C are views showing examples of three pieces of image data that are to be superimposed. FIG. 10A is a view showing an example of a fluorescent image G1 having a region (an all-pixel aligned part) P1 where all pixels are printed and a region (an alternate pixel aligned part) P2 where pixels arranged in a staggered pattern. FIG. 10B is a view showing an example of a multi-gradation image G2 that is superimposed and printed on the fluorescent image G1. FIG. 10C is a view showing an example of a binary image G3 that is superimposed and printed on the fluorescent image G1. Furthermore, FIG. 11 shows an example of an image obtained by superimposing the multi-gradation image G2 and the binary image G3 on the fluorescent image G1.

In the example shown in FIG. 10A, the all-pixel aligned part P1 is formed to surround the alternate pixel aligned part P2. Such a fluorescent image G1 as shown in FIG. 10A improves the appearance. Such a fluorescent image G1 as shown in FIG. 10A may be printed on a recording medium in advance, or may be printed immediately before superimposing and printing another image. FIGS. 10B and 10C show images whose region is at least partially superimposed and printed on a region of the fluorescent image G1 printed on the recording medium. For example, the multi-gradation image G2 shown in FIG. 10B and the binary image depicted in FIG. 10C are respectively superimposed on the fluorescent image G1 shown in FIG. 10A and printed as illustrated in FIG. 11.

Figure 12:
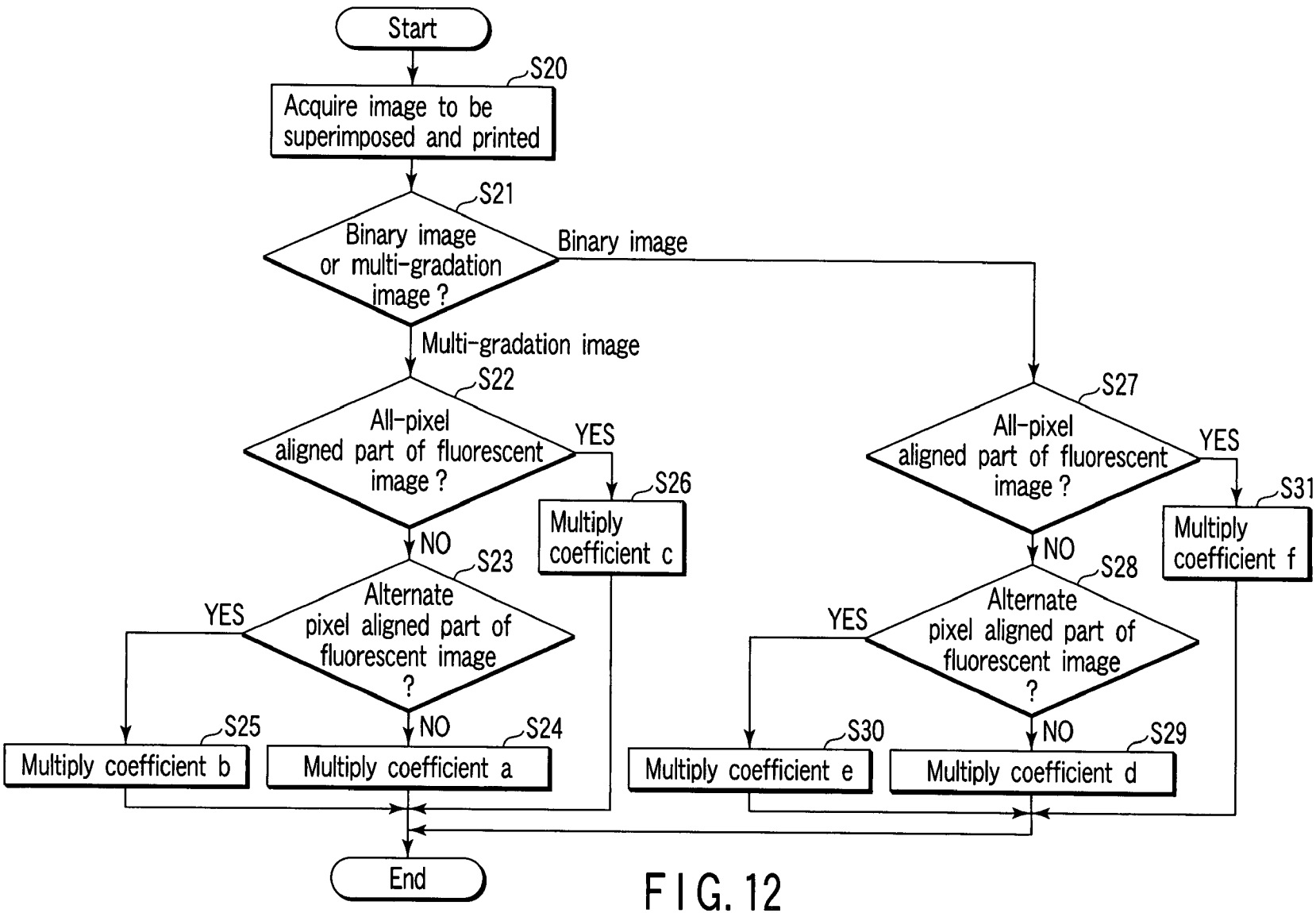
FIG. 12 is a flowchart for explaining a flow of processing by a second image processing method.

FIG. 12 is a flowchart schematically showing a flow of image processing according to the second image processing method.

Here, it is assumed that a different image is printed on a recording medium on which a fluorescent image (a background image, a specific region) having an all-pixel aligned part and an alternate pixel aligned part is printed. It is to be noted that the all-pixel aligned part of the fluorescent image is printed on the recording medium by driving all heat generators in the thermal head, and the alternate pixel aligned part of the fluorescent image is printed on the recording medium by alternately driving the heat generators in the thermal head (the alternate driving mode). Moreover, regions of the all-pixel aligned part and the alternate pixel aligned part of the fluorescent image printed on the recording medium are specified by, e.g., coordinate values on the recording medium.

First, the image reading section 1 receives an image that is to be printed on the recording medium having the fluorescent image printed thereon (a step S20). For example, in case of forming such an image as shown in FIG. 11, the image reading section 1 receives such a multi-gradation image as shown in FIG. 10B and such a binary image as depicted in FIG. 10C. It is to be noted that an image received by the image reading section 1 may be an image read by, e.g., a scanner, or may be an image read from an external device. The input correcting section 2 and the color correcting section 3 performs predetermined correction processing to the image received by the image reading section 1. The image corrected by the input correcting section 2 and the color correcting section 3 is used as an image that is printed on the recording medium having the fluorescent image printed thereon.

When the image (a print image) that is to be printed on the recording medium having the fluorescent image printed thereon is acquired, the image superimposing section 4 judges whether this print image is a binary image or a multi-gradation image (a step S21). It is to be noted that control is executed in accordance with a case where the print image is a binary image and a case where it is a multi-gradation image in this example. This structure is adopted in order to perform control in accordance with characteristics of each pixel constituting the binary image and characteristics of each pixel constituting the multi-gradation image. However, the same control may be executed no matter whether the print image is the binary image or the multi-gradation image.

Further, when it is determined that the print image is the multi-gradation image based on the above-explained judgment (a step S21, the multi-gradation image), the image superimposing section 4 determines a position on the recording medium having the fluorescent image printed thereon at which each pixel of the multi-gradation image is printed. When each printing position of the print image is determined, the image superimposing section 4 judges whether the printing position of each pixel of the multi-gradation image is the all-pixel aligned part of the fluorescent image, the alternate pixel aligned part of the fluorescent image, or a region other than the fluorescent image (steps S22 and S23). It is to be noted that the heat control processing section 5 may perform this judgment.

With respect to each pixel determined to have a printing position that is present in a region other than the fluorescent mage based on the judgment, the heat control processing section 5 controls an energy supplied to a heat generator that prints such a pixel to have a value obtained by multiplying a predetermined reference value by a coefficient a as control of printing such a pixel (a step S24). As a result, each pixel of the multi-gradation image having a printing position that is present in the region other than the fluorescent image is printed on the recording medium by using an appropriate energy obtained by multiplying the reference value by the coefficient a. For example, in case of printing a binary image in the region other than the fluorescent image, when printing processing is effected with an energy having the predetermined reference value, the coefficient a is set to "1".

Furthermore, with respect to each pixel determined to have a printing position that is present at the alternate pixel aligned part of the fluorescent image, the heat control processing section 5 controls an energy that is supplied each heat generator that prints such a pixel to have a value obtained by multiplying the predetermined reference value by a coefficient b as control of printing such a pixel (a step S25). As a result, each pixel in the print image whose printing position is present in the alternate pixel aligned part of the fluorescent image is printed on the recording medium with an appropriate energy obtained by multiplying the reference value by the coefficient b. For example, when the coefficient a is set to "1", the coefficient b is set to be less than 1. This setting is adopted to perform control of printing the binary image at the alternate pixel aligned part of the fluorescent image with an energy smaller than an energy that is used when printing the binary image in the region other than the fluorescent image.

Moreover, with respect to each pixel determined to have a printing position at the all-pixel aligned part of the fluorescent image based on the above-explained judgment, the heat control processing section 5 controls an energy that is supplied to each heat generator that prints such a pixel to have a value obtained by multiplying the predetermined reference value by a coefficient c as control of printing such a pixel (a step S26). As a result, each pixel in the print image whose printing position is present at the all-pixel aligned part of the fluorescent image is printed on the recording medium with an appropriate energy obtained by multiplying the reference value by the coefficient c. For example, the coefficient c is set to a value smaller than the coefficient b. This setting is adopted to effect control of printing the binary image at the all-pixel aligned part of the fluorescent image with an energy smaller than an energy that is used to print the binary image at the alternate pixel aligned part of the fluorescent image.

Additionally, when it is determined that the print image is the binary image based on the above-described judgment (the step S21, the binary image), the image superimposing section 4 determines a position on the recording medium having the fluorescent image printed thereon at which each pixel of the binary image is printed. When each printing position of the print image is determined, the image superimposing section 4 judges whether the printing position of each pixel of the binary image is present at the all-pixel aligned part of the fluorescent image, the alternate pixel aligned part of the fluorescent image, or in a region other than the fluorescent image (steps S27 and S28).

With respect to each pixel determined to have a printing position in the region other than the fluorescent image based on the judgment, the heat control processing section 5 controls an energy supplied to each heat generator that prints such a pixel to have a value obtained by multiplying the predetermined reference value by a coefficient d as control of printing such a pixel (a step S29). As a result, each pixel of the print image whose printing position is present in the region other than the fluorescent image is printed on the recording medium with an appropriate energy obtained by multiplying the reference value by the coefficient d. For example, in case of printing the multi-gradation image in the region other than the fluorescent image, when printing processing is carried out by using an energy having the predetermined reference value, the coefficient d is set to "1".

Further, with respect to each pixel determined to have a printing position at the alternate pixel aligned part of the fluorescent image based on the judgment, the heat control processing section 5 controls an energy supplied to each heat generator that prints such a pixel to have a value obtained by multiplying the predetermined reference value by a coefficient e as control of printing such a pixel (a step S30). As a result, each pixel of the print image whose printing position is present at the alternate pixel aligned part of the fluorescent image is printed on the recording medium with an appropriate energy obtained by multiplying the reference value by the coefficient e. For example, when the coefficient d is set to "1", the coefficient e is set to be less than 1. This setting is adopted to effect control of printing the multi-gradation image at the alternate pixel aligned part of the fluorescent image with an energy smaller than an energy that is used to print the multi-gradation image in the region other than the fluorescent image.

Furthermore, with respect to each pixel determined to have a printing position at the all-pixel aligned part of the fluorescent image, the heat control processing section 5 controls an energy supplied to each heat generator that prints such a pixel to have a value obtained by multiplying the predetermined reference value by a coefficient f as control of printing such a pixel (a step S31). As a result, each pixel of the print image whose printing position is present at the all-pixel aligned part of the fluorescent image is printed on the recording medium with an appropriate energy obtained by multiplying the reference value by the coefficient f. For example, the coefficient f is set to a value smaller than the coefficient e. This setting is adopted to perform control of printing the multi-gradation image at the all-pixel aligned part of the fluorescent image with an energy smaller than an energy that is used to print the multi-gradation image at the alternate pixel aligned part of the fluorescent image.

According to the second image processing method, a state of the recording medium (a region where superimposed printing is not performed, a region where superimposed printing is effected at the all-pixel aligned part, a region where superimposed printing is carried out at the alternate pixel aligned part, and others) is judged, and print processing can be effected by using the thermal head to which an optimum energy meeting each judged region is supplied. As a result, even in case of superimposing a part of a different image and performing printing on a recording medium having a background image, e.g., a fluorescent image printed thereon, the image can be uniformly superimposed on a position where superimposed printing is not performed, a position where superimposed printing is carried out at an all-pixel aligned part, and an alternate pixel aligned part, and printing can be carried out.

An example of a printed matter created by the second image processing method will now be explained.

Figure 13:
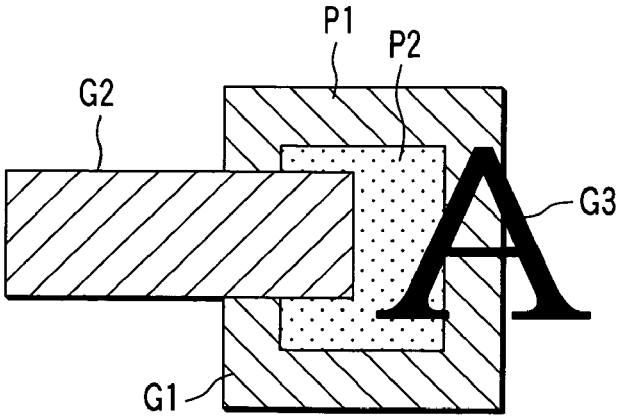
FIG. 13 is a view showing an example of a printed matter created by the second image processing method.

FIG. 13 shows an example of a printed matter 21 created by the second image processing method.

As shown in FIG. 13, on the printed matter 21, a multi-gradation image G2 and a binary image G3 are superimposed and printed on a fluorescent image G1 having an all-pixel aligned part P1 and an alternate pixel aligned part P2. According to the second image processing method, in a region other than the fluorescent image G1, an energy obtained by multiplying a coefficient a and a coefficient d (e.g., an energy having a predetermined reference value) is supplied to each heat generator to print the multi-gradation image G2 and the binary image G3.

Further, according to the second image processing method, at the alternate pixel aligned part P2 of the fluorescent image G1, an energy obtained by a coefficient b and a coefficient e that are smaller than the coefficient a and the coefficient d is supplied to each heat generator to print the multi-gradation image G2 and the binary image G3. Furthermore, according to the second image processing method, at the all-pixel aligned part P1 of the fluorescent image G1, an energy obtained by multiplying a coefficient c and a coefficient f that are smaller than the coefficient b and the coefficient e is supplied to each heat generator to print the multi-gradation image G2 and the binary image G3.

As a result, even if printing positions of the multi-gradation image G2 and the binary image G3 are present in the region other than the fluorescent image G1, and at the all-pixel aligned part P1 of the fluorescent image G1 and the alternate pixel aligned part P2 of the fluorescent image G1 having different heat conductivities and specific heat values, the multi-gradation image G2 and the binary image G3 are entirely uniformly printed. Consequently, on the printed matter, the images that are superimposed and printed on the fluorescent image G1 also have an excellent state, thereby enabling an accurate authenticity judgment.

A third image processing method will now be explained.

Here, heat (thermal storage) generated in each heat generator when driving the thermal head to record an image will be first described.

Figures 14A, 14B, 15, 16:
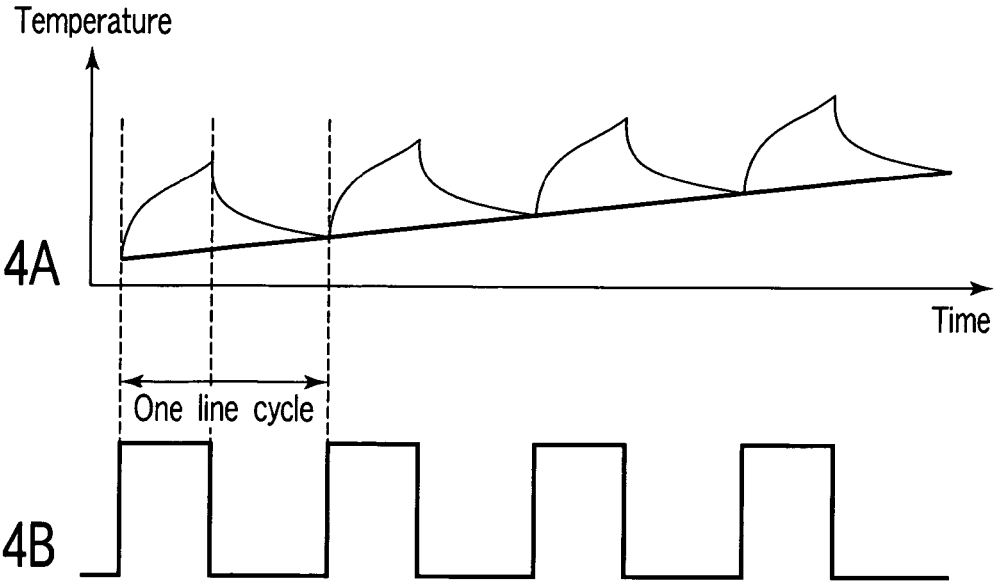
FIG. 14A is a view showing a temperature distribution of heat generators in a thermal head.
FIG. 14B is a view showing an example of application pulses to heat generators that provide such a temperature distribution as shown in FIG. 14A.
FIG. 15 is a view showing a state of an arrangement of pixels in image data where all pixels are effective.
FIG. 16 is a view showing a state of an arrangement of pixels in image data where adjacent pixels are thinned out.

FIG. 14A shows a temperature distribution of each heat generator in the thermal head when such pulses as depicted in FIG. 14B are applied. As shown in FIGS. 14A and 14B, when pulses enter an on state, a current flows through the heat generator. Therefore, a temperature of the heat generator precipitously increases. Thereafter, when the pulses are switched from the on state to an off state, the current no longer flows through the heat generator. Therefore, the temperature of the heat generator gently lowers. In this case, lowering of the temperature of heat generator gently advances. Therefore, when switching the pulses between the on state and the off state with a predetermined cycle, the pulses may again enter the on state before the temperature of the heat generator is completely lowered. In this case, even if the pulses having the same pulse width are applied, a temperature when the pulses enter the on state differs. Therefore, the highest temperature of the heat generator varies.

That is, when turning on/off the pulses with such a cycle as the pulses enter the on state before the temperature of the heat generator is completely lowered is repeated, as shown in FIGS. 14A and 14B, the temperature of the heat generator (the highest temperature and the temperature when the pulses enter the on state) is exponentially increased as indicated by a solid line in FIG. 14A. This means that, when pulses having a fixed pulse width are simply supplied with a predetermined cycle to print a plurality of lines, a temperature of each heat generator is exponentially increased.

In order to control such a phenomenon, a pulse number (a cycle of pulses) and a pulse width must be appropriately changed. For example, as temperature control over each heat generator (thermal storage control), the number of continuously printed lines (corresponding to the number of pixels continuously printed by each heat generator at the time of printing), i.e., the number of times of turning on pulses with a specific cycle is counted, and the pulse number or the pulse width is changed in accordance with this count value. Furthermore, the pulse number or the pulse width is changed by, e.g., multiplying a reference pulse width or a reference pulse number required to print a noticed pixel by a coefficient (a thermal storage control coefficient) that varies in accordance with a count number of lines that are continuously printed (how many lines including pixels in a direction toward the past are continuously printed from a line to be printed). For example, as the thermal control coefficient, a value that varies without becoming equal to or above 1 is used.

Thermal storage control when printing a superimposed image will now be explained.

In regard to a superimposed image having a binary image (second image data) being superimposed on a multi-gradation image (first image data) in which respective pixels are arranged in a staggered pattern, the number of lines in which pixels are continuous may vary depending on a region where the binary image is superimposed and other regions (regions where the binary image is not superimposed). Therefore, as to the superimposed image, the number of continuous lines may differ depending on a case where a region in which the binary image is superimposed is printed and a case where a region in which the binary image is not superimposed is printed. Accordingly, a thermal storage control coefficient required to change a pulse width or a pulse number of supplied to the thermal head differs.

FIG. 15 shows an arrangement of pixels in a region where the binary image is superimposed (an all-pixel aligned part). In an image formed of pixels having such an arrangement as shown in FIG. 15, lines including pixels that should be continuously printed are aligned. Therefore, when printing an image formed of pixels having such an arrangement as shown in FIG. 15, it is considered that the number of lines that are continuously printed should be counted in accordance with each line in the sub-scanning direction.

On the other hand, FIG. 16 shows an arrangement of pixels in a region where the binary pixel is not superimposed (an alternate pixel aligned part). In an image formed of pixels having such an arrangement as shown in FIG. 16, since the pixels are alternately arranged, pixels that should be continuously printed by each heat generator appear every two lines. That is, when printing an image formed of pixels having such an arrangement as shown in FIG. 16, it is considered that the number of lines that are continuously printed should be counted every two lines in the sub-scanning direction.

For example, in image data depicted in FIG. 8B, a pixel between a pixel "53'" and a pixel "55'" is a pixel in a region where the second image data is superimposed. Therefore, pixels that should be printed are continuous in the sub-scanning direction. Therefore, the number of lines that are continuously printed should be counted in accordance with each line in the sub-scanning direction. On the other hand, in the image data shown in FIG. 8B, a pixel "48'" is a pixel in a region where the second image data is not superimposed. Therefore, pixels that should be printed are alternately present in the sub-scanning direction. Therefore, the number of lines that are continuously printed should be counted every two lines in the sub-scanning direction.

In order to assuredly respectively print the region where the binary image is superimposed and other regions in the superimposed image, the optimum continuous line number counting method and thermal storage control coefficient must be executed in accordance with each region.

A flow of the third image processing method will now be explained in detail.

Figure 17:
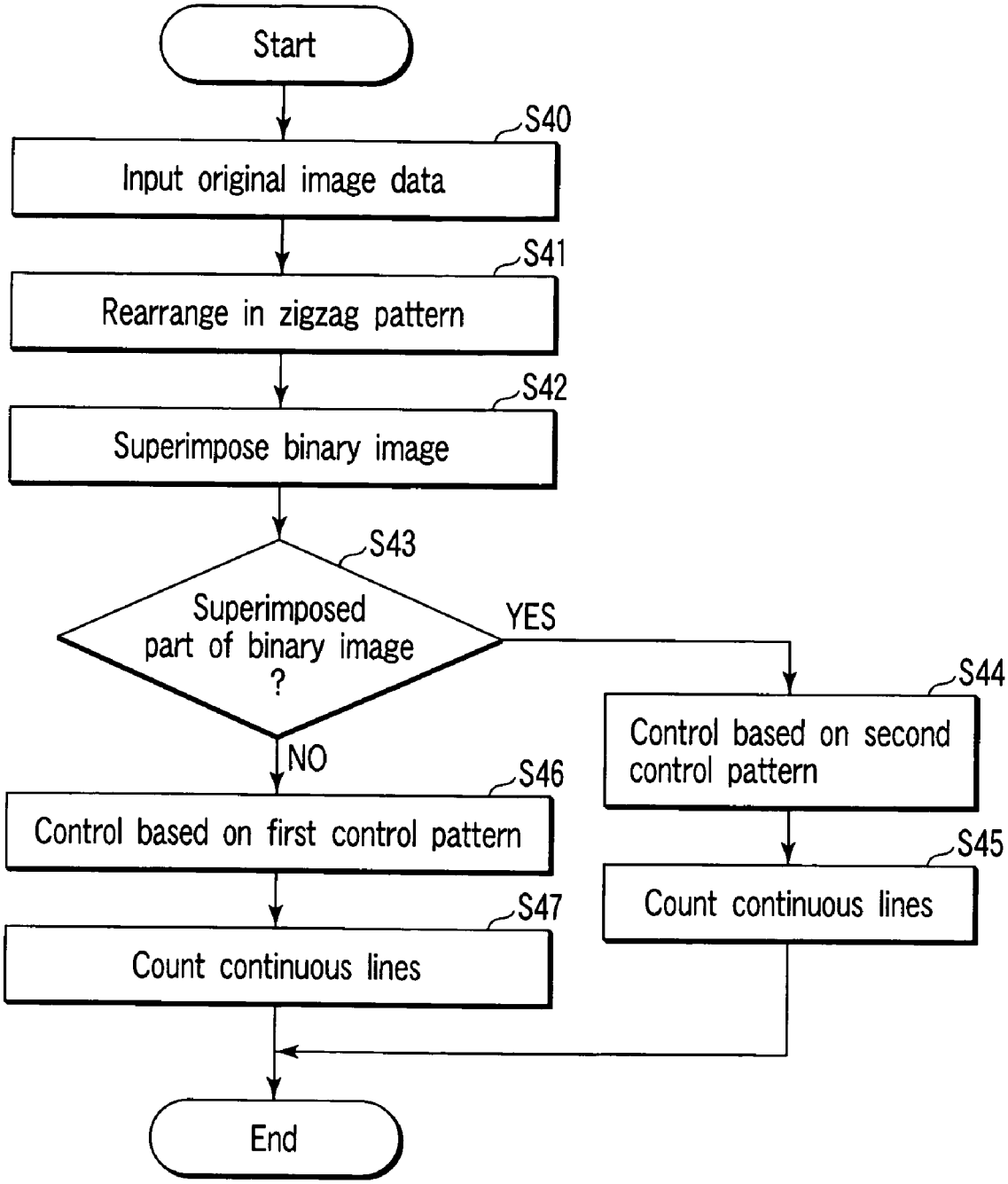
FIG. 17 is a flowchart for explaining a flow of processing by a third image processing method.

FIG. 17 is a flowchart schematically showing a flow of the third image processing method.

In regard to this third image processing method, a processing method of superimposing a different image (second image data) on a multi-gradation image (first image data) acquired by the scanner section 1 and printing an obtained superimposed image will be explained like the first image processing method. It is to be noted that processing at steps S40 to S43 shown in FIG. 17 is the same as the processing at the steps S10 to S13 depicted in FIG. 6 and explained as the first image processing method, and hence a detailed explanation will be omitted.

First, the scanner section 1 acquires monochrome original image (first image) data in which respective pixels are separated into Y, M, and C or Y, M, C, and K (a step S40). The input correcting section 2 and the color correcting section 3 perform desired data processing to the respective pixels in the first image data acquired by the scanner section 1. The first image data processed by the input correcting section 2 and the color correcting section 3 is supplied to the image superimposing section 4. The image superimposing section 4 rearranges the respective pixels in the first image data into a staggered pattern (a step S41). When the respective pixels in the first image data are rearranged into the staggered pattern, the image superimposing section 4 performs processing of superimposing another image (second image data) on the image data in which the respective pixels are rearranged in the staggered pattern (a step S42).

When the image superimposing section 4 superimposes the second image data on the first image data, the heat control processing section 5 performs heat control processing with respect to the engine section 6 in accordance with a state of each pixel in the superimposed image and the number of lines that are continuously printed (a continuous line number) (steps S43 to S47). Here, it is determined that the continuous line number is a value counted by a non-illustrated counter based on later-explained processing at a step S45 or S47.

That is, the heat control processing section 5 judges whether each pixel in the superimposed image generated by the image superimposing section 4 is a pixel having each pixel in the second image data superimposed thereon (a step S43).

With respect to each pixel determined to have no second image data superimposed thereon, the heat control processing section 5 controls the engine section 6 based on the first heat control pattern to perform printing on a recording medium while making reference to the continuous line number counted before printing this pixel (a step S46). When the pixel determined to have no second image data superimposed thereon is printed, the heat control processing section 5 counts the continuous line number every two lines (a step S47). That is because counting is performed on the assumption that an image in a region where the second image data is not superimposed has respective pixels being arranged in the staggered pattern.

Furthermore, with respect to each pixel determined to have the second image data superimposed thereon (or a pixel around this pixel), the heat control processing section 5 controls the engine section 6 based on the second heat control pattern to effect printing on the recording medium while making reference to the continuous line number counted before printing this pixel (a step S44). When the pixel determined to have no second image data superimposed thereon is printed, the heat control processing section 5 counts the continuous line number in accordance with each line (a step S45). That is because this counting is performed on the assumption that an image in a region where the second image data is superimposed has all pixels being arranged.

A printed matter created by the third image processing method will now be explained.

According to the third image processing method, as shown in FIG. 9, a printed matter that is the same as the printed matter 11 created by the first image processing method can be obtained. That is, in a printed matter created by the third image processing method, as shown in FIG. 9, a binary image (second image data) embedded in a multi-gradation image (first image data) in which respective pixels are arranged in a staggered pattern can be readily identified. Moreover, in the printed matter created by the third image processing method, a region where a binary image is embedded and a region where the binary image is not embedded can be respectively printed by optimum heat controls. Therefore, according to the third image processing method, a high-quality printed matter can be efficiently created.

According to the third image processing method, in regard to a superimposed image in which second image data is embedded in some of regions of first image data, the number of continuously printed lines is counted every line in a region having pixels on which the second image data is superimposed, and the number of continuously printed lines is counted every two lines in a region having pixels on which the second image data is not superimposed. Thermal storage control over each heat generator is carried out in accordance with these continuous line numbers, thereby printing the superimposed image on the recording medium.

As a result, according to the third image processing method, each region of the superimposed image in which the second image data is embedded in the first image data can be formed on the recording medium based on appropriate thermal storage control. As a result, according to the third image processing method, a continuous binary image, e.g., a character embedded in an alternate pixel aligned part of a multi-gradation image can be assuredly printed on the recording medium, and such an image region can be also appropriately printed on the recording medium.

Moreover, according to the third image processing method, counting the number of lines that are continuously printed is optimized in accordance with a state of an image. As a result, thermal storage control according to the number of lines that are continuously printed can be efficiently and optimally carried out in conformity to a state of an image, thereby efficiently creating a high-quality printed matter. Additionally, in a printed matter created by the third image processing method, an image superimposed on an image printed based on the alternate driving mode can be assuredly printed, and the superimposed image can be securely restored.

A fourth image processing method will now be explained in detail.

In regard to thermal storage control according to the continuous line number explained in conjunction with the third image processing method, an optimum control method varies depending on a part where a pixel is formed (a state on a recording medium). For example, a degree of thermal storage on each heat generator in the thermal head varies depending on whether a background image, e.g., a fluorescent image is printed on a recording medium on which an image is printed.

That is, a thermal storage degree of each heat generator in the thermal head varies depending on whether a region on the recording medium where an image is recorded is a region where a background image, e.g., a fluorescent image is printed, an all-pixel aligned part or an alternate pixel aligned part of the fluorescent image. Therefore, in order to carry out optimum thermal storage control with respect to various kinds of regions on the recording medium, it is preferable to discriminate various regions on the recording medium and use a thermal storage control coefficient in accordance with each of these regions to perform thermal storage control. This fourth image processing method is a method of performing optimum thermal storage control in accordance with a state of the recording medium at a printing position where an image is printed.

The fourth image processing method will be explained hereinafter on the assumption that a multi-gradation image shown in FIG. 10B and a binary image depicted in FIG. 10C are superimposed and printed on a recording medium having such a fluorescent image as shown in FIG. 10A printed thereon as illustrated in FIG. 11.

In a region on the recording medium where a fluorescent image is not printed, there is an image receiving layer alone at a part where each pixel is formed. On the other hand, in a region on the recording medium where the fluorescent image is printed, there is an ink layer of the fluorescent image. Therefore, a heat conductivity and specific heat vary depending on the region where the fluorescent image is printed and other regions. This means that a thermal storage degree of each heat generator in the thermal head also varies depending on the region where the fluorescent image is printed and other regions.

Further, the ink layer of the fluorescent image corresponding to all pixels is assuredly present at the all-pixel aligned part of the fluorescent image. On the other hand, a position having no ink layer of the fluorescent mage or a position having a small ink layer of the fluorescent image is present at the alternate pixel aligned part of the fluorescent image. Therefore, a heat conductivity and specific heat varies depending on the all-pixel aligned part of the fluorescent image and the alternate pixel aligned part of the fluorescent image. This means that a thermal storage degree of each heat generator in the thermal head also varies depending on the all-pixel aligned part of the fluorescent image and the alternate pixel aligned part of the fluorescent image.

Processing by the fourth image processing method will now be explained in detail.

Figure 18:
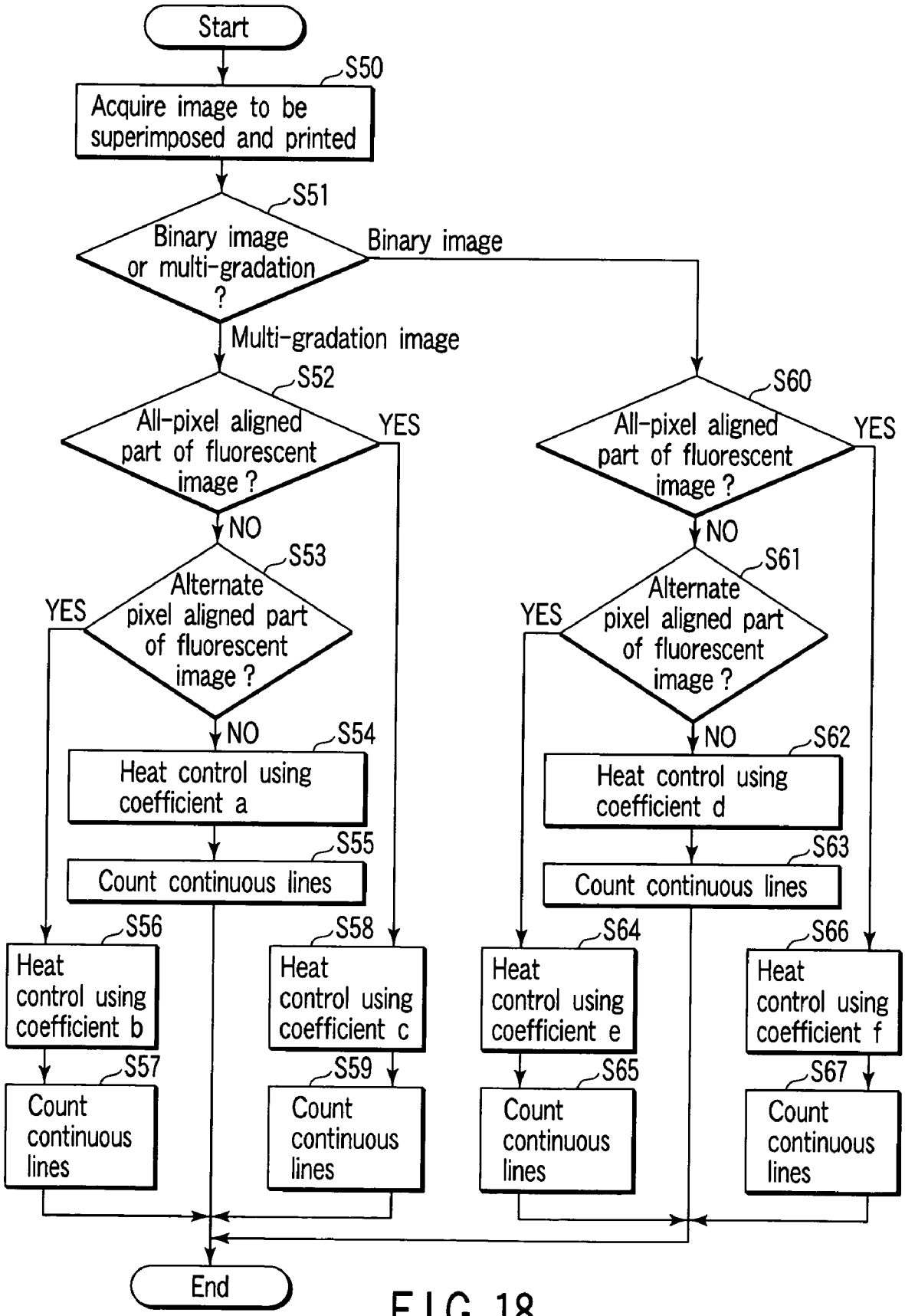
FIG. 18 is a flowchart for explaining a flow of processing by a fourth image processing method.

FIG. 18 is a flowchart for explaining a flow of processing based on the fourth image processing method.

In regard to this fourth image processing method, a processing method of printing an image on a recording medium having a fluorescent image as a background image printed thereon will be explained like the second image processing method. It is to be noted that processing at steps S50 to S53, S60, and S61 shown in FIG. 18 is the same as the processing at the steps S20 to S23, S27, and S28 depicted in FIG. 12, thereby omitting a detailed explanation.

That is, when an image (a print image) that is to be printed on the recording medium having a fluorescent image printed thereon is acquired (a step S50), the heat control processing section 5 performs heat control processing with respect to the engine section 6 in accordance with a state of the recording medium, a state of the print image, a state of the recording medium at a printing position of the print image, and the number of continuously printed lines (a continuous line number) judged by the image superimposing section 4 (steps S51 to S67). Here, it is determined that the continuous line number is a value counted by a non-illustrated counter based on later-explained processing at steps S55, S57, S63, S65, and S67.

First, when an image (a print image) to be printed on the recording medium having a fluorescent image recorded thereon is acquired (the step S50), the image superimposing section 4 judges whether this print image is a binary image or a multi-gradation image (a step S51). When it is determined that the print image is the multi-gradation image based on this judgment (the step S51, the multi-gradation image), the image superimposing section 4 determines a position on the recording medium having the fluorescent image printed thereon where each pixel in the multi-gradation image is printed. When each printing position of the print image is determined, the image superimposing section 4 judges whether the printing position of each pixel in the multi-gradation image is present at an all-pixel aligned part of the fluorescent image, an alternate pixel aligned part of the fluorescent image, or in a region other than the fluorescent image (steps S52 and S53). It is to be noted that the heat control processing section 5 may perform such judgments.

With respect to each pixel in the multi-gradation image determined to have a printing position that is present in the region other than the fluorescent image, the heat control processing section 5 performs control of printing such a pixel based on a coefficient a concerning printing control of the multi-gradation image with respect to the region other than the fluorescent image and a continuous line number counted before printing this pixel (a step S54). That is, the heat control processing section 5 calculates a value obtained by multiplying a predetermined reference value by the coefficient a as a value of an energy that is supplied to a heat generator that prints the pixel determined to have the printing position being present in the region other than the fluorescent image. The heat control processing section 5 controls the energy having the calculated value in accordance with the continuous line number counted before printing this pixel.

As a result, this pixel in the multi-gradation image is printed in the region other than the fluorescent image. Moreover, when the pixel in the multi-gradation image is printed in the region other than the fluorescent image, the heat control processing section 5 counts the continuous line number in accordance with each line (a step S55). Consequently, the pixel in the multi-gradation image whose printing position is present in the region other than the fluorescent image is printed on the recording medium with the energy whose energy value obtained by multiplying the reference value by the coefficient a is controlled in accordance with the number of continuously printed lines.

In relation to each pixel in the multi-gradation image determined to have a printing position being present at the alternate pixel aligned part of the fluorescent image based on the judgment, the heat control processing section 5 performs control of printing this pixel based on a coefficient b concerning printing control over the multi-gradation image with respect to the alternate pixel aligned part of the fluorescent image and a continuous line number counted before printing this pixel (a step S56). That is, the heat control processing section 5 calculates a value obtained by multiplying the predetermined reference value by the coefficient b as a value of an energy supplied to each heat generator that prints the pixel determined to have a printing position being present at the alternate pixel aligned part of the fluorescent image. Moreover, the heat control processing section 5 controls the energy having the calculated value in accordance with the continuous line number counted before printing this pixel.

As a result, the pixel in the multi-gradation image is printed at the alternate pixel aligned part of the fluorescent image. Additionally, when the pixel in the multi-gradation image is printed at the alternate pixel aligned part of the fluorescent image, the heat control processing section 5 counts the continuous line number in accordance with each line (a step S57). Consequently, the pixel in the multi-gradation image whose printing position is present at the alternate pixel aligned part of the fluorescent image is printed on the recording medium with the energy whose energy value obtained by multiplying the reference value by the coefficient b is controlled in accordance with the number of continuously printed lines.

In relation to each pixel in the multi-gradation image determined to have a printing position being present at the all-pixel aligned part of the fluorescent image, the heat control processing section 5 performs control of printing this pixel based on a coefficient c concerning printing control over the multi-gradation image with respect to the all-pixel aligned part of the fluorescent image and a continuous line number counted before printing this pixel (a step S58). That is, the heat control processing section 5 calculates a value obtained by multiplying the predetermined reference value by the coefficient c as a value of an energy supplied to each heat generator that prints the pixel determined to have a printing position being present at the all-pixel aligned part of the fluorescent image. Further, the heat control processing section 5 controls the energy having the calculated value in accordance with the continuous line number counted before printing this pixel.

As a result, the pixel in the multi-gradation image is printed at the all-pixel aligned part of the fluorescent image. Furthermore, when the pixel in the multi-gradation image is printed at the all-pixel aligned part of the fluorescent image, the heat control processing section 5 counts the continuous line number in accordance with each line (a step S59). Consequently, the pixel in the multi-gradation image whose printing position is present at the all-pixel aligned part of the fluorescent image is printed on the recording medium with the energy whose energy value obtained by multiplying the reference value by the coefficient c is controlled in accordance with the number of continuously printed lines.

Furthermore, when it is determined that the print image is a binary image based on the judgment (the step S51, the binary image), the image superimposing section 4 determines a position on the recording medium having the fluorescent image printed thereon at which each pixel in the binary image is printed. When each printing position of the print image is determined, the image superimposing section 4 judges whether the printing position of each pixel in the binary image is present at an all-pixel aligned part of the fluorescent image, an alternate pixel aligned part of the fluorescent image, or in a region other than the fluorescent image (steps S60 and S61).

In relation to each pixel in the binary image determined to have a printing position being present in the region other than fluorescent image based on the judgment, the heat control processing section 5 performs control of printing the pixel based on a coefficient d concerning printing control over the binary image with respect to the region other than the fluorescent image and a continuous line number counted before printing this pixel (a step S62). That is, the heat control processing section 5 calculates a value obtained by multiplying the predetermined reference value by the coefficient d as a value of an energy supplied to each heat generator that prints the pixel determined to have a printing position being present in the region other than the fluorescent image. Moreover, the heat control processing section 5 controls the energy having the calculated value in accordance with the continuous line number counted before printing this pixel.

As a result, the pixel in the binary image is printed in the region other than the fluorescent image. Additionally, when the pixel in the binary image is printed in the region other than the fluorescent image, the heat control processing section 5 count the continuous line number in accordance with each line (a step S63). Consequently, the pixel in the binary image whose printing position is present in the region other than the fluorescent image is printed on the recording medium with the energy whose energy value obtained by multiplying the reference value by the coefficient d is controlled in accordance with the number of continuously printed lines.

In relation to each pixel in the binary image determined to have a printing position being present at the alternate pixel aligned part of the fluorescent image, the heat control processing section 5 performs control of printing this pixel based on a coefficient e concerning printing control over the binary image with respect to the alternate pixel aligned part of the fluorescent image and a continuous line number counted before printing this pixel (a step S64). That is, the heat control processing section 5 calculates a value obtained by multiplying the predetermined value by the coefficient e as a value of an energy supplied to each heat generator that prints the pixel determined to have a printing position being present at the alternate pixel aligned part of the fluorescent image. Further, the heat control processing section 5 controls the energy having the calculated value in accordance with the continuous line number counted before printing this pixel.

As a result, the pixel in the binary image whose printing position is present at the alternate pixel aligned part of the fluorescent image is printed. Furthermore, when the pixel in the binary image is printed at the alternate pixel aligned part of the fluorescent image, the heat control processing section 5 counts the continuous line number in accordance with each line (a step S65). As a result, the pixel in the binary image whose printing position is present at the alternate pixel aligned part of the fluorescent image is printed on the recording medium with the energy whose energy value obtained by multiplying the reference value by the coefficient e is controlled in accordance with the number of continuously printed lines.

In relation to each pixel in the binary image determined to have a printing position being present at the all-pixel aligned part of the fluorescent image, the heat control processing section 5 performs control of printing this pixel based on a coefficient f concerning printing control over the binary image with respect to the all-pixel aligned part of the fluorescent image and a continuous line number counted before printing the pixel (a step S66). That is, the heat control section 5 calculates a value obtained by multiplying the predetermined reference value by the coefficient f as a value of an energy supplied to each heat generator that prints the pixel in the binary image determined to have the printing position being present at the all-pixel aligned part of the fluorescent image. Additionally, the heat control processing section 5 controls the energy having the calculated value in accordance with the continuous line number counted before printing this pixel.

As a result, the pixel in the binary image is printed in the region other than the fluorescent image. Further, when the pixel in the binary image is printed at the all-pixel aligned part of the fluorescent image, the heat control processing section 5 counts the continuous line number in accordance with each line (a step S67). Consequently, the pixel in the binary image whose printing position is present at the alternate pixel aligned part of the fluorescent image is printed on the recording medium with the energy whose energy value obtained by multiplying the reference value by the coefficient f is controlled in accordance with the number of continuously printed lines.

In the fourth image processing method, a state of the recording medium (a region where superimposed printing is not performed, a region where superimposed printing is performed at an all-pixel aligned part, a region where superimposed printing is carried out at an alternate pixel aligned part, and others) is judged, an optimum value of an energy is calculated to print each pixel in each of these judged regions, and the energy whose calculated value is controlled based on the number of continuously printed lines is supplied to the thermal head, thereby effecting the printing processing.

As a result, according to the fourth image processing method, even if a part of a different image is superimposed and printed on the recording medium having a background image, e.g., a fluorescent image printed thereon, the image can be uniformly superimposed and printed at a position where superimposed printing is not performed, a position where superimposed printing is carried out at an all-pixel aligned part, or an alternate pixel aligned part.

A printed matter created by the fourth image processing method will now be explained.

According to the fourth image processing method, the same printed matter as the a printed matter 21 created by the second image processing method shown in FIG. 13 can be obtained. That is, in the printed matter created by the fourth image processing method, a multi-gradation image G2 and a binary image G3 are superimposed and printed on a fluorescent image G1 having an all-pixel aligned part P1 and an alternate pixel aligned part P2 as shown in FIG. 13.

Furthermore, according to the fourth image processing method, pixels printed in a region other than the fluorescent image G1, and at the alternate pixel aligned part P2 of the fluorescent image G1 and the all-pixel aligned part P1 of the fluorescent image G1 are printed by control in accordance with a coefficient corresponding to each region and the number of continuously printed lines. That is, according to the fourth image processing method, it is possible to create the printed matter on which an image is printed with an energy optimized in accordance with a state of the recording medium on which the image is printed and a count value of the number of continuously printed lines. As a result, the high-quality printed matter can be efficiently created in accordance with a state of the recording medium.

Moreover, in the printed matter created by the fourth image processing method, an image such as a multi-gradation image or a binary image can be entirely uniformly printed irrespective of the region other than the fluorescent image G1, the all-pixel aligned part P1 of the fluorescent image G1, and the alternate pixel aligned part P2 of the fluorescent image G1 that are different from each other in thermal conductivity and specific heat. As a result, in the printed matter created by the fourth image processing method, an image superimposed and printed on the fluorescent image can have an excellent state, thereby enabling an accurate authenticity judgment and others.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming method of forming an image on a recording medium by using a printing mechanism, comprising:

discriminating a region where second image data is superimposed from a region where the second image data is not superimposed in relation to a superimposed image obtained by superimposing the second image data on first image data in which respective pixels are arranged in a staggered pattern;

controlling the printing mechanism based on a first control pattern when forming an image in a region determined as the region where the second image data is not superimposed in the superimposed image; and controlling the printing mechanism based on a second control pattern different form the first control pattern when forming an image in a region determined as the region where the second image data is superimposed in the superimposed image, wherein the first data is a multi-gradation image, and the second image data is a binary image.

2. The image forming method according to claim 1, further comprising:

inputting the first image data;

converting respective pixels in the input first image data into an arrangement having a staggered pattern; and producing a superimposed image in which the second image data is superimposed on the first image data in which the respective pixels are converted into the arrangement having the staggered pattern.

3. The image forming method according to claim 1, wherein the printing mechanism sequentially forms in a sub-scanning direction a plurality of pixels along a main scanning direction, controlling the printing mechanism in accordance with a continuous line number counted every two lines when forming an image in the region where the second image data is not superimposed based on control with the first control pattern; and controlling the printing mechanism in accordance with a continuous line number counted every line when forming an image in the region where the second image data is superimposed by using the printing mechanism controlled based on the second control pattern.

4. The image forming method according to claim 3, wherein the printing mechanism is constituted of a plurality of heat generators aligned in the main scanning direction, and the control in accordance with the continuous line number is control of controlling heat stored in each heat generator.

5. An image forming apparatus that forms an image on a recording medium by using a printing mechanism, comprising:

a discriminating section that discriminates a region where second image data is superimposed from a region where the second image data is not superimposed in relation to a superimposed image obtained by superimposing the second image data on first image data in which respective pixels are arranged in a staggered pattern;

a first control section that controls the printing mechanism based on a first control pattern when forming an image in a region determined as the region where the second image data is not superimposed in the superimposed image; and a second control section that controls the printing mechanism based on a second control pattern different from the first control pattern when forming an image in a region determined as the region where the second image data is superimposed in the superimposed image, wherein the printing mechanism sequentially prints in a sub-scanning direction a plurality of pixels along a main scanning direction, the first control section further controls the printing mechanism in accordance with a continuous line number counted every two lines when forming an image in the region where the second image data is not superimposed by using the printing mechanism that is controlled based on the first control pattern, and the second control section further controls the printing mechanism in accordance with a continuous line number counted every line when forming an image in the region where the second image data is superimposed by using the printing mechanism that is controlled based on the second control pattern.

6. The image forming apparatus according to claim 5, wherein the printing mechanism is constituted of a plurality of heat generators aligned in the main scanning direction, and the control in accordance with the continuous line number in each of the first control section and the second control section is control of controlling heat stored in each heat generator.

* * * * *